United States Patent [19]

Fischer et al.

[11] 4,410,793

[45] Oct. 18, 1983

[54] ELECTRIC HOTPLATE

[75] Inventors: Karl Fischer, Am Gänsberg 23, D-7519 Oberderdingen, Fed. Rep. of Germany; Hermann Knauss; Felix Schreder, both of Oberderdingen, Fed. Rep. of Germany

[73] Assignee: Karl Fischer, Fed. Rep. of Germany

[21] Appl. No.: 298,750

[22] Filed: Sep. 2, 1981

[30] Foreign Application Priority Data

Sep. 9, 1980 [DE] Fed. Rep. of Germany ..... 3033828

[51] Int. Cl.[3] ..... H058 3/68

[52] U.S. Cl. ..... 219/460; 219/449; 219/462; 219/464; 219/467

[58] Field of Search ..... 219/449, 450, 452, 459, 219/460, 461, 462, 463, 464, 467, 445

[56] References Cited

U.S. PATENT DOCUMENTS

| | | | |
|---|---|---|---|
| 2,570,975 | 10/1951 | Osterheld | 219/462 X |
| 2,664,492 | 12/1953 | Fischer | 219/462 X |
| 2,678,991 | 5/1954 | Amfitheatrof | 219/464 |
| 2,684,430 | 7/1954 | Bieling | 219/449 |
| 3,384,737 | 5/1968 | Doutre | 219/460 |
| 3,569,672 | 3/1971 | Hurko | 219/464 |
| 3,632,983 | 1/1972 | Dills | 219/464 |
| 3,646,321 | 2/1972 | Siegla | 219/464 |
| 3,684,862 | 8/1972 | Fischer et al. | 219/450 |
| 3,686,477 | 8/1972 | Dills et al. | 219/462 |
| 3,733,462 | 5/1973 | Bouchard et al. | 219/464 |
| 3,739,149 | 6/1973 | Fischer et al. | 219/445 |
| 3,789,189 | 1/1974 | Fischer et al. | 219/464 |
| 3,826,898 | 7/1974 | Hurko et al. | 219/462 |
| 3,838,249 | 9/1974 | Detterbeck | 219/460 |
| 3,909,592 | 9/1975 | Eidr | 219/462 |
| 3,987,275 | 10/1976 | Hurko | 219/461 |
| 4,032,750 | 6/1977 | Hurko | 219/464 |
| 4,122,330 | 10/1978 | Fischer et al. | 219/449 |
| 4,135,081 | 1/1979 | Fischer | 219/449 |
| 4,330,701 | 5/1982 | Fischer et al. | 219/450 |

FOREIGN PATENT DOCUMENTS

| | | | |
|---|---|---|---|
| 1531091 | 6/1968 | France | 219/463 |
| 97774 | 1/1961 | Norway | 219/463 |

*Primary Examiner*—Volodymyr Y. Mayewsky

[57] ABSTRACT

An electric hotplate (11) has a metal plate-like or inverted dish-shaped circular hotplate member (12) against whose bottom are pressed by spring elements (25) thin flexible tubular heaters (31), while interposing a multilayer insulation (28). A support disk (26) is placed between insulation (28) and spring elements (25). According to a variant a reinforcement is provided, which may also be placed between the insulation and the tubular heaters. The electric hotplate has a low heat storing capacity and a very flat upper cooking surface (32), even under operating conditions.

35 Claims, 10 Drawing Figures

ELECTRIC HOTPLATE

FIELD OF THE INVENTION

The invention relates to the field of electric hotplates in general, and in particular, to hotplates with flexible, spring-loaded heating elements.

Prior Art

The hotplate conventionally used in Europe and as described for example in U.S. Pat. No. 4 122 330 has a cast iron hotplate member with a flat cooking or boiling surface and ribs on the bottom, which define spiral slots in which are located helical heating resistors in a compressed embedding material. These hotplates have proved very satisfactory and due to the contact heat transfer to the cooking vessel have an adequate performance level and a good efficiency in steady state. The efficiency level is somewhat lower when bringing up to the boil because it is also necessary to heat the relatively heavy hotplate member.

Various attempts have been made to reduce the heat storing capacity by replacing the casting by thinner metal plates, reference being made e.g. to U.S. Pat. No. 3 826 898, German Utility Model No. 78 11 510, and German Offenlegungsschriften No. (published specifications) 28 05 093 and 20 21 177. In these constructions the heating elements are constituted by tubular heaters fixed to the bottom of the hotplate member by soldering or metal parts surrounding the tubular heater. As a result during their thermal expansion the tubular heaters also influence the plate. Thus, in all these attempts the plates were not flat in operation and consequently the heat transfer to the saucepan positioned on them was impaired. It must also be remembered that such a curvature of the hotplate produces a chain reaction in that the engaging parts of the cooking vessel are heated more than those parts which are not in engagement, so that the hotplate and cooking vessel curve away from one another and thereby impair the heat transfer even more.

Another attempt at reducing the capacity of cooking units was based on the glass ceramic cooker. Thus, for example, U.S. Pat. No. 3,789,189 describes a heating unit for a glass ceramic plate in which the tubular heaters are resiliently pressed against the said plate by means of sheet metal cross-members. Pressure is applied from the outside through a support shell. However, a glass ceramic material is a poor heat conductor, so that under comparable conditions the performance level is lower. U.S. Pat. Nos. 3,632,983 and 3,686,477 also described glass ceramic cookers, but there is no resilient pressing action of the tubular heaters therein.

It is finally pointed out that it is conventional practice in certain countries to use cookers in which the cooking vessels are placed directly on the tubular heaters which are flat at the top. In this case the heat storing capacity is very low, so that the efficiency when bringing to the boil is low. Moreover, they have disadvantages during use, particularly due to their open, interrupted cooking surface enabling overflowing food being cooked to pass into the interior of the cooker.

SUMMARY OF THE INVENTION

The problem of the invention is to provide an electric hotplate object in which the flatness of the cooking surface is retained under all operating conditions, accompanied by a low heat storing capacity and a good efficiency level when bringing to the boil and in the steady state.

These and other objects of this invention are accomplished by an electric hotplate having a metal hotplate member with, in the heated area, an upper, substantially closed, planar cooking surface and a smooth, unribbed bottom surface, at least one tubular heater embedded in electrically insulating material and having a flat surface for engaging the bottom surface of the hotplate member and a base plate connected to the hotplate member and enclosing the at least one tubular heater, comprising: at least one spring element supported between the at least one tubular heater and the base plate for resiliently pressing the tubular heater against the bottom surface of the hotplate member; a heat-resistant insulation layer interposed between the spring member and the at least one tubular heater; and, the tubular heater being thin and flexible, whereby heat condition to the cooking surface is enhanced and losses due to thermal inertia are reduced.

There are no longer any ribs on the bottom of the hotplate member between which the heating elements are embedded, so that its weight and heat storing capacity are reduced. There is no longer any need for it to be produced by the sand casting process and, for example, sheet metal can be used, so that the thickness of the plate walls can be reduced. The relatively thin tubular heaters used have a much lower weight than the corresponding embedding material in the hitherto used hotplates and the tubular heaters no longer need be closely juxtaposed and can instead be spaced from one another. In addition, the embedding for the heater coils in the tubular heaters is normally compressed to such an extent by stretching and rolling processes, that its thermal conductivity is better. Surprisingly the distance from the heater coil according to the invention to the cooking surface, i.e. the bottom of the saucepan is much less (approximately 3.5 mm compared with 6 mm in the hitherto known hotplate), so that despite a further intermediate member, namely the tubular heater covering, a much more direct heat transfer to the cooking surface is possible.

As a result of the resilient pressing of the tubular heater against the bottom of the hotplate permanent engagement the absence of disturbing noise during heating or cooling (expansion and contraction) is ensured and the interposed heat-resistant insulation ensures a good efficiency level, even in the steady state.

Further advantages and features of the embodiments of the invention can be gathered from the the description and the drawings. It is particularly stressed that the fixing of the hotplate to detachable parts in the hotplate edge area ensures that the hotplate is not deformed by installation measures. The described method of fixing also contributes to the solution of the problem.

BRIEF DESCRIPTION OF THE DRAWINGS

Embodiments of the invention are shown in the drawings and are described hereinafter.

DETAILED DESCRIPTION OF THE PREFERRED EMBODIMENTS

Figure 1:
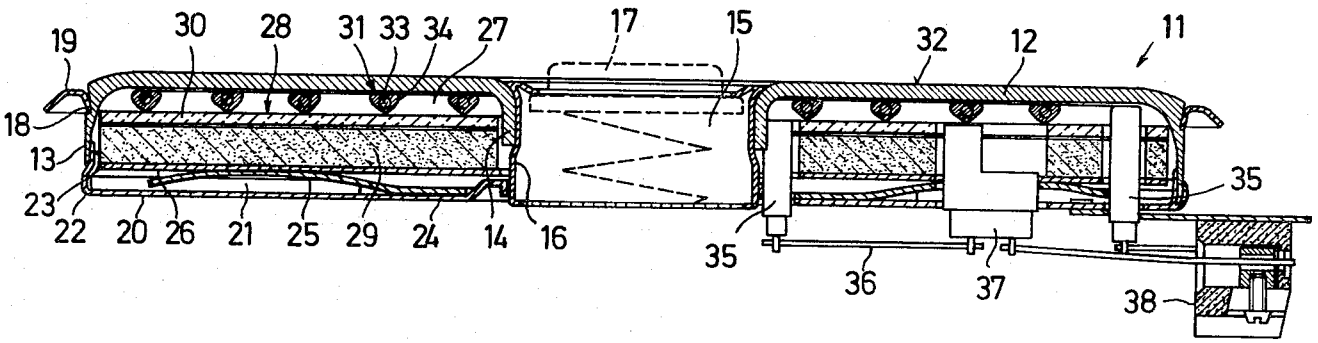
FIG. 1 is a vertical section through a hotplate, according to the invention.
Figure 3:
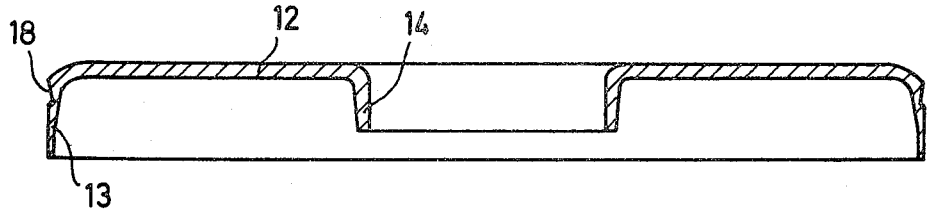
FIG. 3 is the hotplate member in cross-section.
Figure 2:
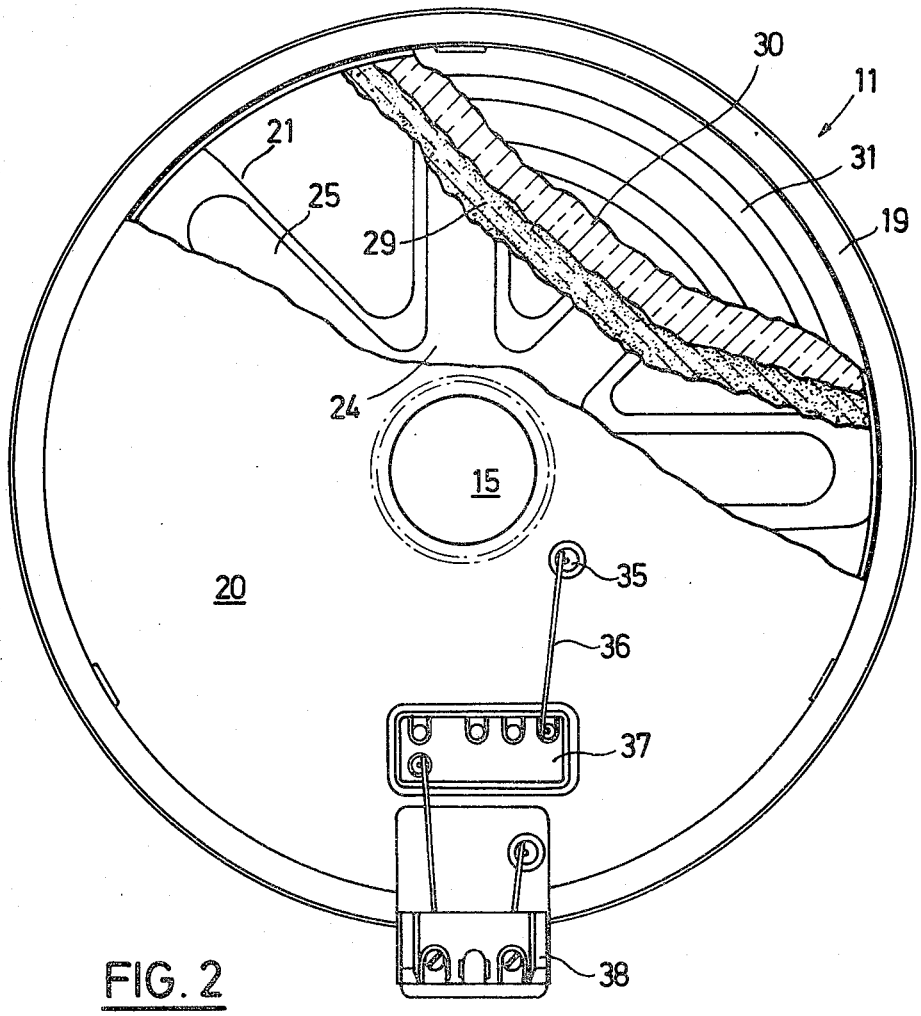
FIG. 2 is a partly broken away view, from below, of the hotplate.

FIGS. 1 to 3 show an electric hotplate 11 having a hotplate member 12 comprising a circular ring, preferably of stainless chrome steel, having an outer rim 13 and an inner rim 14, which are substantially perpendicularly downwardly directed. The inner rim 14 surrounds an opening 15, which serves to receive a conventional thermostat 17 in the form of an expansion liquid-filled thermostat member, which is resilient and can be pressed against the bottom of the saucepan and is indicated by a broken line. A support sleeve 16 for the thermostat is pressed into the opening, which with its upper flange limits the upward movement of the thermostat member and fixes the latter so as to be movable to a limited extent by a lower flange. This arrangement is, for example, described in detail in German Pat. No. 24 22 687 (corresponding in British Pat. No. 15 09 078), to which reference should be made.

After a rounded transition, outer rim 13 is relatively thin and has a triangular circumferntial notch 18 (FIG. 3) into which is snapped a spillage rim 19 in the form of a profiled ring made from thin stainless steel plate. The cross-section of the spillage rim is an inverted, asymmetrical, relatively flat and rounded V. The annular space between the outer and inner rims 13, 14 is closed by a base plate 20, which is circular and is joined in its central area, e.g. by welding to the support sleeve 16. The upwardly directed outer edge 23 of the base plate and which is provided with projections 22 is placed on the lower edge of rim 13, as described in greater detail hereinafter in FIGS. 9 and 10, on which it is supported and centred.

A spring member 24 which, in the represented embodiment is in the form of an 8-armed star with a central hole (FIG. 2) and comprises a spring plate rests on the base plate. Eight spring elements 25, in the form of star arms or rays, project outwardly from the annular hub as upwardly bent, flat spring arms. Base plate 20 is provided with reinforcing fins in such a way that the spring member and spring elements are always located in the lower part of the base plate.

In the central area of the heating ring zone, i.e. with reference to the complete hotplate formed between the inner and outer rims, spring elements 25, press relatively far out on a support disk 26, a circular, flat sheet metal being positioned in the annulus 27 enclosed by base plate 20 and covering the bottom of insulation 28, which in the represented embodiment is in the form of two layers. The lower, thicker layer comprises a compressed loose insulating material, preferably a flaky to powdery $Al_2O_3$, which is compressed for forming a substantially flat ring disk. Although this material has very high thermal insulating properties, it is not very strong mechanically. The top and/or bottom can, for example, be covered by a glass cloth as a support layer. To protect the support layer from the high temperatures on the tubular heater a second insulating layer 30, which comprises a fleece of an inorganic fibrous insulating material is placed on the first layer 20. The fibres are of $Al_2O_3$, which combine a good mechanical strength with a high thermal stability.

Insulation 28 comprising layers 29 and 30 is pressed by spring elements 25 against the bottom of tubular heaters 31 and presses the flattened top thereof against the bottom of the hotplate member. Cooking surface 32 at the top of the hotplate member should be as flat as possible in this heated ring area.

Tubular heaters conventially comprise a metallic covering of stainless steel with a very limited thickness (less than 0.4 mm, preferably 0.3 mm) in which helical heating resistors 33 are placed in the highly compressed, electrically insulating embedding material. The tubular heater covering 34 is given a triangular shape, while forming the upper contact surface and has width dimensions of 4 mm or less, so that a very flexible heater is obtained. It is bent in the form of a spiral ring and under the pressure of spring element 25 and the intermediate layer of insulation is pressed with a good thermal contact against the bottom of the hotplate member.

In the present case the heating resistor comprises a coil, which in the inner and outer areas of annulus 27 has downwardly directed deflections 35 to which are welded the hotpoint connections 36. A thermal cut-out 37 is intermediately connected with respect to one of the connections and senses the temperature at the bottom of the tubular heater. The connections lead to a connecting piece 38 fitted to a laterally projecting connecting plate fixed to the base plate and the connections are connected there to connecting lines coming from the switch or regulator. The heating resistor can be constructed as a tandem coil, i.e. two coaxially directed coils with the same diameter, which are electrically connected in parallel. They have a relatively large heat-emitting surface and can be bent with a very small bending radius.

The support disk 26 can be ribbed to increase rigidity. An electric hotplate is produced having a thin and optionally corrosion-proof hotplate member with a thickness of less than 3 mm and on to which can be pressed by means of an effective insulation the tubular heater, which is flexible from the bottom and can be easily engaged. The heated annulus 27 is sealed, so that there is no risk of thermal losses by convection. As a result of the good contact between the relatively wide-apart tubular heaters, whose spacing is approximately $1\frac{1}{2}$ times the width, the temperature in the tubular heater is kept relatively low so that it does not tend to burn out. The spring elements have an adequate elongation in order to ensure pressure action via the insulation even if the insulation is compressed somewhat in operation. The hotplate can be manufactured at lower cost and can be operated with a higher efficiency than other hotplates, which are comparable from the serviceability standpoint.

Figure 4:
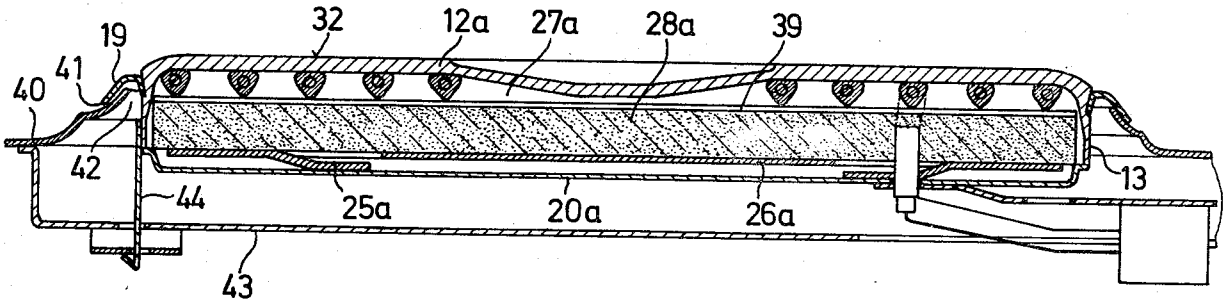
FIG. 4 is a longitudinal section through another embodiment with the same main features.

The construction of FIG. 4 differs from that of FIGS. 1 to 3 in that the hotplate has no central thermostat, so that the hotplate member **12*a* has no central opening and is instead merely pressed in somewhat at this point, so that the annular, flat cooking surface 32** is recessed. The same parts carry the same reference numerals for all the embodiments.

Correspondingly the hotplate member has no inner rim, so that the inner annulus **27*a* surrounds the entire bottom of the hotplate. The construction of the outer and spillage rim 13, 19 is the same as in FIG. 1. Base plate 20***a* passes over the entire bottom of the hotplate and is both supported and fixed in the vicinity of outer rim 13. A support disk 26*a*, which is in the form of a circular sheet metal disk and simultaneously serves as the spring member is parallel and spaced with respect to outer rim 13. In the present embodiment radially inwardly directed tongues or arms are stamped out of the support disk 26*a*, are bent downwards and form spring elements 25*a*, which are resiliently supported on base plate 20*a*. Support disk 26 presses uniformly on insulation 28*a*, which in the present case is made from a single layer of compressed inorganic material, whose top is provided with a coating 39 which protects the insulation from thermal and mechanical actions of the tubular heater. It can be an asbestos fibre layer or a ceramic coating.

Figure 5:
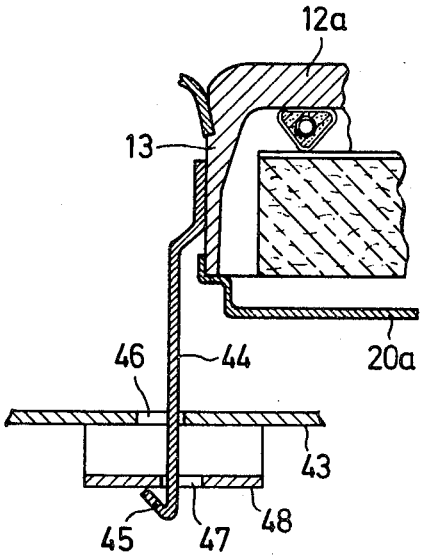
FIGS. 5 and 6 are details of the fixing of the hotplate according to FIG. 4.
Figure 6:
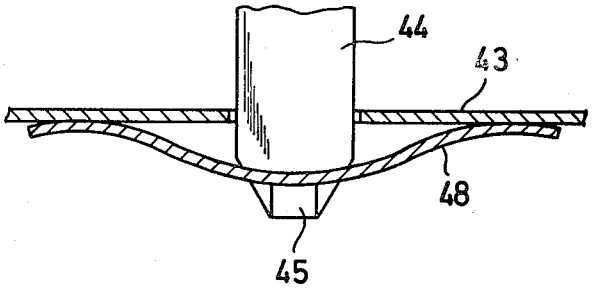

It is pointed out that the use of support disk 26 for spring mounting purposes leads to an economy of one part, although in this case the disk must be made from a springy material. FIG. 4 also shows the attachment of the hotplate. The outer lower edge of the spillage rim 19 rests on a step of a cooker plate or hob 40 located in the vicinity of an upwardly inclined overflow edge 41 surrounding the installation opening 42 of the plate. The cooker or hob is closed at the bottom by a cover 43 supported on the bottom of the cooker plate. The hotplate is held on to this cover, whose function could also be performed by a corresponding bow-shaped member in the case of a different cooker construction, by a plurality and preferably three fastening members or clips 44, which are shown in detail in FIGS. 5 and 6. They are fixed to the outside of rim 13 by spot welding and project vertically downwards in the form of narrow strips. At the end thereof projections 45 are formed by a barb-like bending over and said projections project through openings 46 in base plate 44 and through corresponding, offset openings 47 in a bow-like leaf spring 48. The latter is fitted at one end to cover 43 and is supported on the latter at its other end in order to increase the spring tension. Opening 47 is located in the central area of leaf spring 48. It is also pointed out that due to the offsetting of the openings, together with the barb-like slope of projection 45 on introducing the clips 44 through both openings there must be a certain elastic bending of said clips until the projections reach the bottom of leaf spring 48. This ensures that projection 45 is securely held on the leaf spring, so that accidental detachment is impossible. During installation the hotplate is mounted until the spillage rim 19 rests on the corresponding point of the cooker plate, after which spring 48 is pressed upwards until projection 45 engages. As only one edge of the opening participates in the engagement process (in FIG. 5 the right-hand edge of opening 46 and the left-hand edge of opening 47), the openings could also be replaced by corresponding edge arrangements. The fastening members 44 also protect the hotplate against torsion. FIG. 5 also shows the support and centering of base plate 20*a* on rim 13. The rim is received in an angular stamping of the base plate.

Figure 7:
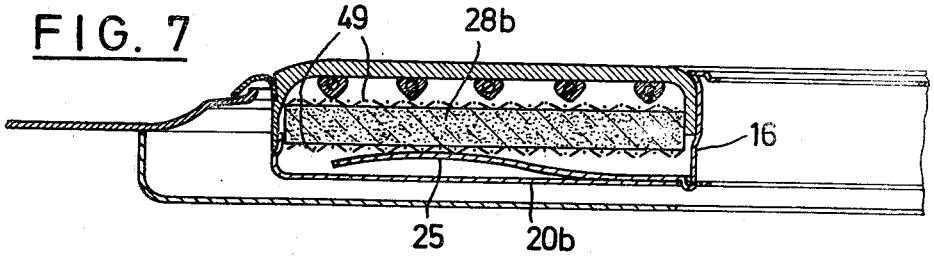
FIG. 7 is a partial section through an embodiment with a different insulation.

FIG. 7 shows an electric hotplate which, with the exception of the insulation, corresponds to that of FIG. 1. The insulation 28*b* is made from a compressed inorganic insulating material, e.g. an $Al_2O_3$ fibrous fleece into whose top and bottom is pressed a reinforcement 49 in the form of a stainless steel wire fabric to such an extent that it is firmly joined to the insulation, but forms the outsides of the latter. This preferably takes place during the wet pressing of the insulation. The reinforcement, which could also comprise some other metal structure, e.g. a metal sheet provided with corresponding stampings, ensures an extremely robust and rigid insulating part, which still forms very good thermal insulation. The tubular heaters only engage on the reinforcement in punctiform manner. Nevertheless the pressing force is reliably transferred and the spring elements 25 can act directly on the bottom reinforcement without any support disk. The base plate 20*b* is fixed by flanging the support sleeve 16.

Figure 8:
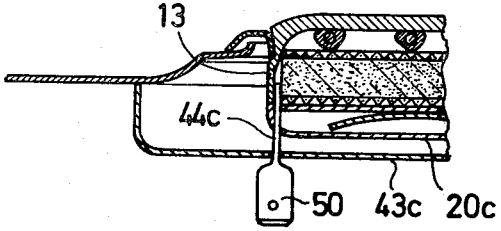
FIG. 8 is a partial section through the embodiment of FIG. 7 with a supporting disk placed under the insulation and one design of the hotplate fixing means.

FIG. 8 shows a variant of the hotplate fastening on cover 43*c*. In this case there is a punctiform connection of a tongue to the inside of rim 13, which projects through openings in base plate 20*c*. Tongue 44*c* is introduced through an opening in cover 43*c* and is secured by twisting the sheet metal tongue. The twisted end forms a flat connector 50 on to which can be fitted a plug of an earthing line.

Figure 9:
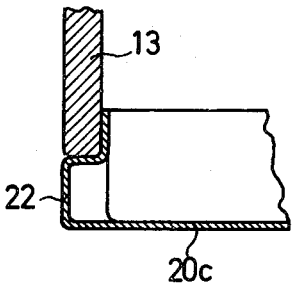
FIG. 9 is a detail of the support of the base plate according to FIGS. 7 and 8.

FIG. 9 is a larger scale detail of the support of base plate 20*c* on the lower edge of rim 13. In the vicinity of its outer upwardly directed edge the base plate has zonally stamped projections 22 on which are supported the lower edge of rim 13. The remaining upwardly directed edge 23 of the base plate projects together with the inner face of rim 13 for centering purposes.

Figure 10:
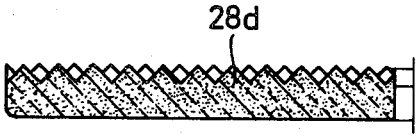
FIG. 10 is an alternative embodiment of the insulation.

FIG. 10 shows insulation 28*d*, whose top is shaped in pyramidal manner. The shaping of this relatively firm insulating material ensures that there is substantially only a punctiform engagement of the tubular members and any manufacturing imprecisions in connection with the insulating members are compensated by the partial pressing in of the tubular heaters. The heat transfer is also reduced by the punctiform engagement. The features described hereinbefore in connection with individual embodiments can be used individually or in combination in other embodiments.

We claim:

1. An electric hotplate having a metal hotplate member with, in the heated area, an upper, substantially closed planar cooking surface and a smooth, unribbed bottom surface, at least one tubular heater embedded in electrically insulating material and having a flat surface for engaging the bottom surface of the hotplate member and a base plate connected to the hotplate member and enclosing the at least one tubular heater, the hotplate comprising:

at least one spring element supported between the at least one tubular heater and base plate for resiliently pressing the the least one tubular heater against the bottom surface of the hotplate member;

a heat-resistant insulation layer interposed between the spring member and the at least one tubular heater;

the tubular heater being thin and flexible, and so arranged as to define an unheated central area;

the hotplate member having a thermostat opening in the central area, surrounded by a downwardly directed inner rim; and, a thermostat support sleeve press-fitted in the thermostat opening defining an annular enclosure for the at least one tubular heater, the base plate being connected to the support sleeve in the central area whereby heat conduction to the cooking surface is enhanced and energy losses due to thermal inertia are reduced.

2. An electric hotplate according to claim 1, wherein the hotplate member is made from steel and has a thickness of less than 3 mm.

3. An electric hotplate according to claim 1, wherein the hotplate member has an outer slot, and is surrounded by a spillage rim in the form of a thin, profiled, stainless steel ring which can be snapped into the outer slot.

4. An electric hotplate according to claim 1, wherein the at least one tubular heater is arranged in a spiral pattern, adjacent turns of the spirally arranged tubular heater being spaced from one another by a distance which considerably exceeds the width of the at least one tubular heater.

5. An electric hotplate according to claim 4, wherein the width of the at least one tubular heater is not greater than 5.5 mm and the at least one tubular heater has an outer wall covering not more than 0.4 mm thick.

6. An electric hotplate according to claim 1, comprising a plurality of tubular heating sections.

7. An electric hotplate according to claim 1, wherein the at least one tubular heater has two heating resistor wires wound as a tandem coil.

8. An electric hotplate according to claim 1, wherein the insulation layer is reinforced.

9. An electric hotplate according to claim 8, wherein the reinforcement comprises a perforated metal structure pressed into the surface of the insulating material.

10. An electric hotplate according to claim 9, wherein the perforated metal structure is a steel-wire reinforced fabric.

11. An electric hotplate according to claim 1, wherein the insulation layer is in multilayer form, comprising a layer of fibrous insulating material engaging the at least one tubular heater and a layer of a compressed loose insulating material placed below the fibrous layer.

12. An electric hotplate according to claim 1, wherein the top of the insulation layer is profiled.

13. An electric hotplate according to claim 1, comprising a sheet metal support disk disposed beneath the insulation layer, the spring element acting on the disk.

14. An electric hotplate according to claim 13, wherein the sheet metal support disk is ribbed.

15. An electric hotplate according to claim 1, wherein the spring element is constructed as a plurality of leaf springs emanating from a common part, in the form of a plurality of star-like arms.

16. An electric hotplate according to claim 15, wherein the base plate the reinforcing corrugations and the leaf springs are arranged in the reinforcing corrugations.

17. An electric hotplate having a metal hotplate member with, in the heated area, an upper, substantially closed planar cooking surface and a smooth, unribbed bottom surface, at least one tubular heater embedded in electrically insulating material and having a flat surface for engaging the bottom surface of the hotplate member and a base plate connected to the hotplate member and enclosing the at least one tubular heater, the electric hotplate comprising:

the hotplate member having an outer rim directed substantially perpendicularly downwardly from the cooking surface, the base plate resting against the lower edge of the outer rim and being centered thereon;

a compressible heat-resistant insulation layer interposed between the at least one tubular heater and the base plate;

at least one spring element supported by and between the insulation layer and the base plate for resiliently pressing the at least one tubular heater against the bottom surface of the hotplate member, the at least one spring element having an elongation characteristic which exceeds the permanent deformation of the insulation layer; and, the tubular heater being thin and flexible, whereby heat reduction to the cooking surface is enhanced and energy losses due to thermal inertia are reduced.

18. An electric hotplate according to claim 17, wherein the base plate has stamped projections at its perimeter on which the outer rim of the hotplate member is supported.

19. An electric hotplate according to claim 17, wherein the layer is provided with a heat-resistant coating.

20. An electric hotplate according to claim 17, wherein the spring element is stamped and bent from the support disk (*26a*).

21. An electric hotplate according to claim 17, comprising edge-mounted detachable hold-down parts.

22. An electric hotplate according to claim 21, comprising a plurality of fastening members fitted to the outer rim of the hotplate member.

23. An electric hotplate according to claim 22, wherein the fastening members are formed as tongues which engage on the detachable parts.

24. An electric hotplate according to claim 22, wherein the tongues have barb-like projections which hook behind the detachable parts.

25. An electric hotplate according to claim 24, wherein the spring element comprises at least one leaf spring fitted to the detachable parts the barb-like projection being hooked behind the detachable parts.

26. An electric hotplate according to claim 24, wherein the detachable parts have two edges formed on offset openings arranged in succession in the insertion direction of the tongues, whereby, at right angles to said insertion direction, the edges are at a smaller distance from one another than the corresponding dimensions of the tongues and the projection.

27. An electric hotplate according to claim 22, wherein a connector for a ground connection is shaped from the tongue-like fastening member.

28. An electric hotplate according to claim 17, wherein the hotplate has an outer slot, and is surrounded by a spillage rim in the form of a thin, profiled, stainless steel ring which can be snapped into the outer slot.

29. An electric hotplate according to claim 17, wherein the at least one tubular heater is arranged in a spiral pattern, adjacent turns of the spirally arranged tubular heater being spaced from one another by a distance which considerably exceeds the width of the at least one tubular heater.

30. An electric hotplate according to claim 17, wherein the insulation layer is in multilayer form, comprising a layer of fibrous insulating material engaging the at least one tubular heater and a layer of a compressed loose insulating material placed below the fibrous layer.

31. An electric hotplate according to claim 17, comprising a sheet metal support disk disposed beneath the insulation layer, the at least one spring element acting on the disk.

32. An electric hotplate according to claim 31, wherein the sheet metal support disk is ribbed.

33. An electric hotplate according to claim 17, wherein the at least one spring element comprises a plurality of leaf springs emanating from the common part, in the form of a plurality of star-like arms.

34. An electric hotplate according to claim 33, wherein the base plate has reinforcing corrugations and the leaf springs are arranged in the reinforcing corrugations.

35. An electric hotplate having a metal hotplate member with, in the heated area, an upper, substantially closed, planar cooking surface and a smooth, unribbed bottom surface, at least one tubular heater embedded in electrically insulating material and having a flat surface for engaging the bottom surface of the hotplate member and a base plate connected to the hotplate member and enclosing the at least one tubular heater, the electric hotplate comprising:

the hotplate member having an outer rim directed substantially perpendicularly downwardly from the cooking surface, the base plate resting against the lower edge of the outer rim and being centered thereon;

at least one spring element supported between the at least one tubular heater and the base plate for resiliently pressing the tubular heater against the bottom surface of the hotplate member;

a heat-resistant insulation layer interposed between the spring member and the at least one tubular heater;

the tubular heater being thin and flexible, whereby heat conduction to the cooking surface is enhanced and energy losses due to thermal inertia are reduced; and, temperature limiting means disposed immediately adjacent the bottom of the at least one tubular heater, for interrupting power to the at least one tubular heater when a predetermined temperature is exceeded, whereby the operating temperature of the electric hotplate may be very precisely monitored and controlled.

* * * * *

UNITED STATES PATENT AND TRADEMARK OFFICE

CERTIFICATE OF CORRECTION

PATENT NO. : 4,410,793

DATED : October 18, 1983

INVENTOR(S) : Fischer et al

It is certified that error appears in the above-identified patent and that said Letters Patent is hereby corrected as shown below:

Column 1, line 65, delete "problem" and insert --object--.
Column 1, line 66, delete "object".
Column 2, line 18, delete "condition" and insert --conduction--.
Column 3, line 28, delete "in" and insert --to--.
Column 3, line 43, delete "centred" and insert --centered--.
Column 4, line 11, delete "conventially" and insert --conventionally--.
Column 6, line 49, delete "the".
Column 6, line 60, insert --and-- after "opening".
Column 6, line 61, delete "the" and insert --said--.
Column 6, line 62, insert --,-- after "area".
Column 7, line 47, delete "the" and insert --has--

(2nd occurr.)

Column 9, line 20, delete "perpendicularly".

Column 10, line 2, delete "thereon" and insert--therein--.

Signed and Sealed this

*Second* Day of *July 1985*

[SEAL]

*Attest:*

DONALD J. QUIGG

*Attesting Officer* *Acting Commissioner of Patents and Trademarks*